United States Patent [19]

LaChance

[11] 4,141,461

[45] Feb. 27, 1979

[54] SECURE BOTTLE WITH NOVEL CAP

[76] Inventor: Ernest J. LaChance, Old Wilton Rd., Milford, N.H. 03055

[21] Appl. No.: 873,871

[22] Filed: Jan. 31, 1978

[51] Int. Cl.[2] ..... B65D 51/18

[52] U.S. Cl. ..... 220/253; 206/1.5; 206/540; 222/513; 215/201

[58] Field of Search ..... 206/1.5, 534, 540, 538, 206/539; 222/153, 516, 513; 221/174, 188, 246, 287, 4; 220/253; 215/201

[56] References Cited

U.S. PATENT DOCUMENTS

| | | | |
|---|---|---|---|
| 3,830,392 | 8/1974 | Kessler et al. | 222/513 X |
| 3,871,522 | 3/1975 | Feldman | 206/540 |
| 4,011,829 | 3/1977 | Wachsmann et al. | 206/534 X |

*Primary Examiner*—George T. Hall

*Attorney, Agent, or Firm*—Robert A. Cesari; John F. McKenna; Andrew F. Kehoe

[57] ABSTRACT

A secure bottle for storing of pills, or the like, wherein the novel cap member comprises a rotatable member and a stationary member positioned for relative rotation with one another; the rotation being opposed by a biasing means between said members; and the rotation also being opposed by a locking construction engaging the member until the upper member is lifted free thereof.

7 Claims, 5 Drawing Figures

SECURE BOTTLE WITH NOVEL CAP

BACKGROUND OF THE INVENTION

In recent years a substantial amount of work has been devoted to producing bottle caps, and related articles, which are so constructed that they are difficult for children to open. Much of the earlier work can be found in U.S. Patent Office Classification 215-9.

A problem with the earlier work is that, in emphasizing the necessity of making the opening of a container difficult, it concentrated on constructions which are also difficult to manipulate when being used by the infirm, or the elderly. This problem has reached such proportions that it has drawn nationwide attention and is believed to have resulted in urging adoption of optional procedures whereby doctors may specify use of conventional caps for some such patients.

SUMMARY OF THE INVENTION

It is a principal object of the invention to provide an improved container closure of the type comprising a compound means for releasing pills from a container.

A further object of the invention is to provide a closure, i.e. caps, which require minimal strength to open and keep open during a pill-removal process.

Still another object of the invention is to provide an economical cap which is resistant to being released by small children, and which features a lifting action as a condition precedent to proceeding with a pill-dispensing process.

Other objects of the invention are to provide the improved and novel processes attendant to manufacture and use of the container caps of the ivention and the novel containers constructed in combination with the novel caps of the invention.

Other objects of the invention will be obvious to those skilled in the art on their reading this invention.

The above objects have been sustantially achieved by the provision of a pill-container (or any secure dispensing container without limitation as to the objects which are secured therein) which is characterized by a normally locked, but ultimately rotatable, top cap member. This top cap member is maintained in a normally closed radial position by a low-strength biasing means. The top member is lifted to unlock it for rotation; thereupon, the top member can be easily rotated by force applied to its circumferential edge until it reaches an open, i.e. pill dispensing position. The pill dispensing position is that wherein openings in the top cap member and a stationary lower cap member come into register with one another to provide a conduit, formed of the two openings, for passage of pills or the like.

A particular advantage of the lifting procedure is that it involves a pulling away of the release from all the other structures of the safety closure, which is not directly related to limiting or facilitating the lift action; this assures a turning action that is easy. This easy turning feature co-acts with maximum leverage provided by the circumference of the lifted member (or by turning of the bottle itself) and, of course, the turning is preferably resisted only by a small biasing force in those embodiments of the invention most advantageous for use by the infirm.

It is also to be noted that vertical movement of the top closure member may be biased toward a downward (locked) position by a spring means. It is desirable and economic that the same spring or biasing means, used to oppose the turning force, be so configured to form means to which also opposes the lifting force.

Finally, it is noted that no matter how difficult a closure is to open, the prior art closures usually do not prevent removal and misplacing of the closure.

In general, it is preferable that the diameter of the closure be large enough to allow very little turning torque. The invention is particularly useful with bottles of about 2 centimeters or larger in diameter. A knurled, or roughened surface proximate the edge of the bottle closure facilitates easy turning. The torque required to turn or to lift the closure need not be substantially more than that necessary to return the closure to its closed and locked position.

IN THE DRAWINGS

Figure 5:
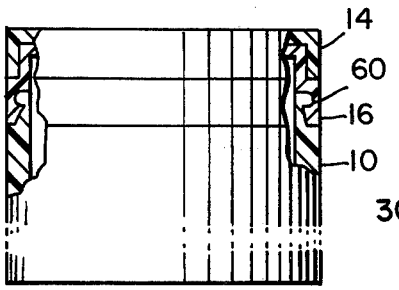

FIG. 5 indicates the locking of the secure cap of the invention to the container.

Figure 1:
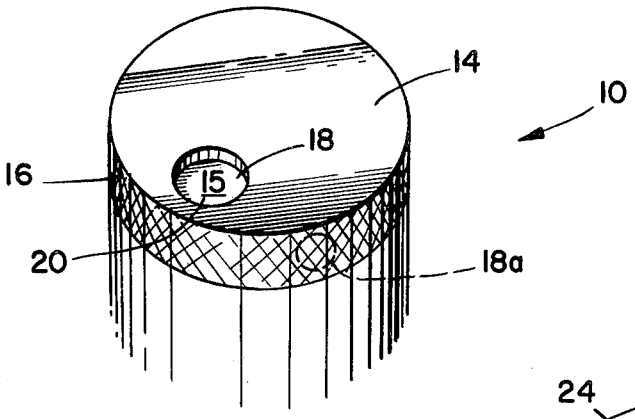
FIG. 1 is a perspective view of a cap prepared according to the invention.
Figure 2:
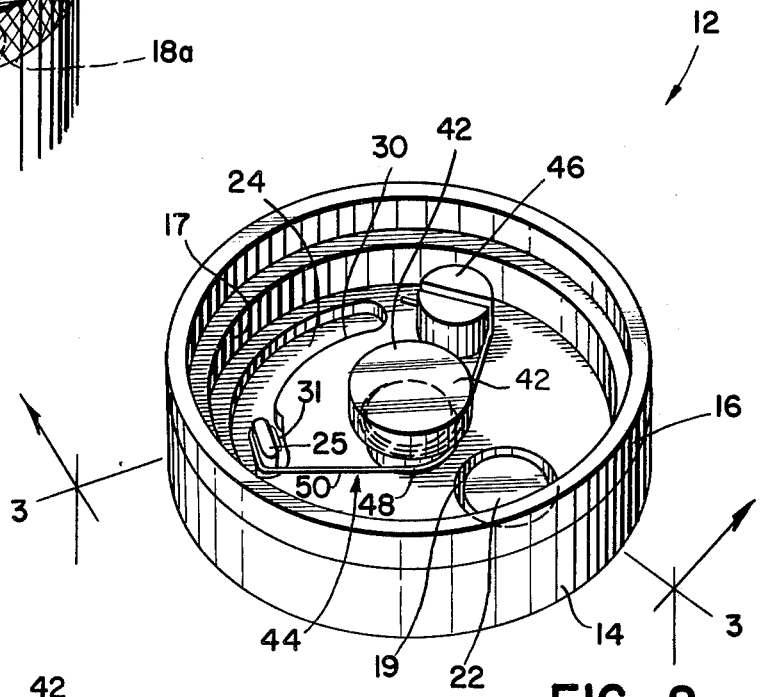
FIG. 2 is a perspective view of the bottom side of the closure assembly of the invention when said closure is in its closed position.
Figure 3:
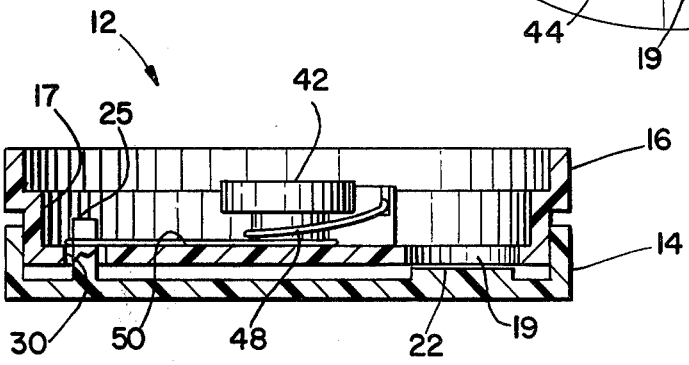
FIG. 3 is a view of the closure of FIGS. 1 and 2 when it is in the closed position, but just after the lifting of the upper closure member.

Referring to FIGS. 1 and 2, it is seen that a container 10 is fitted with a closure 12 which comprises a top, or cap, member 14, and a lower closure member 16 which is fastened in a fixed position on bottle member 12 of container 10. Closure member 16 has a reduced diameter at the top sidewall portion 17 thereof so it can nest into member 14 bringing the top surfaces of each into close proximity. With cap member 14 in a normally closed position, the aperture 18 is positioned over a portion 20 top surface 15 of member 16.

As illustrated in FIG. 2, the structure of the top, i.e. the horizontal or sealing, surface of lower closure member 16 comprises an aperture, or recess 19, into which a downwardly projecting detent, or stud 22 (part of the top closure member 14) will normally fit, thereby locking member 14 against rotation with respect to member 16 in all situations wherein member 14 is not lifted upwardly to remove detent 22 from recess 17.

Figure 4:
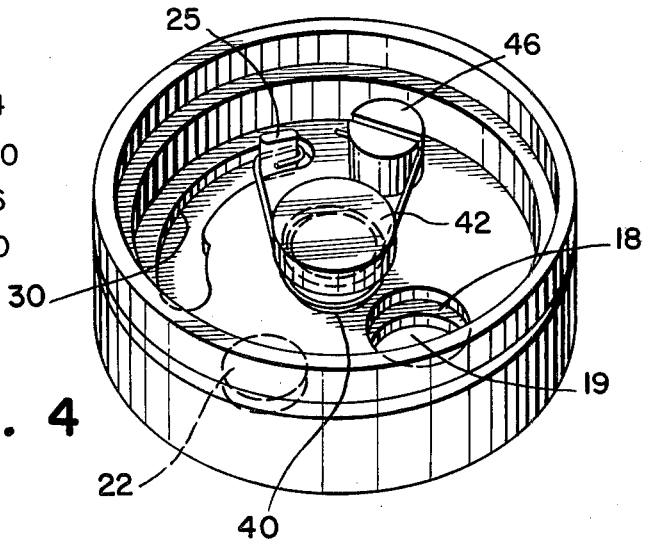
FIG. 4 is a perspective view, as in FIG. 2, but with the closure member rotated to open the closure to passage of pills therethrough.

Lower closure member 16 has still another opening, a slot 24 in the form of an elongated arc segment 24, which receives still another projection 25 of member 14. Once the member 14 is lifted, this slot member 24 limits any rotational movement of member 14 by limiting the angular movement of projection 25. This limit is illustrated by the relative position of the members 14 and 16 in FIG. 4, i.e. in the "open position" to allow dispensing of pills through aperture 18 and 19 showing in register with each other.

It is to be noted that slot 24 comprises a stop means, projection 30, which can prevent relative rotation between the closure members as long as a relatively wide cross-sectional post section 31, of projection 25, is below the level of projection 30. The locking-actions of (a) projection 22 with aperture 17, and (b) section 31 of projection 30 with aperture 24 are similar and one of them may be omitted in some constructions according to the invention. However, when spaced approximately 180 angular degrees from one another, they do coact to achieve the desirable end of allowing use of a more flimsy biasing means and consequently easier opening, while providing the added security of requiring a lifting of the entire cap to permit turning, rather than allowing the mere cocking of one side of the cap to permit lifting. Thus, such a dual locking feature is advantageous and preferred because it contributes to permitting versatility in construction techniques without compromising ease of non-authorized access, as by children.

It is to be noted that there is a third aperture 40 in lower closure member 16. This accomodates passage through member 16 of a vertically moveable shaft 42. Shaft 42 is attached to the central portion of closure member 14 and is enlarged at knob 43 to limit its vertical movement to that necessary to raise projections 22 and 31 above the structure of member 16 which would impede their rotation.

The biasing means in the illustrated embodiment is formed of a single continuous wire spring 44. The spring is anchored, as by anchoring means 46, and thence forms a coiled spring 48 positioned around shaft 42 and provide means to oppose lifting force on member 14 and means to return it to a downward locked position; thence it proceeds in a segment 50 and is attached to projecting stud 25. Spring segment 50 then acts also to resist rotation of cap member 14 and to return cap memeber 14 when force is released.

FIG. 1 illustrated in dotted lines as an alternative embodiment wherein an aperture 18*a* in the sideway 60 may be utilized. In such a circumstance, of course, a corresponding sidewall in the reduced diameter portion of member 16 is required.

In the preferred embodiment of the invention, the cap is locked, as seen in FIG. 5, onto container 10 by press fitting closure member 16 past a slight ridge 60 on the bottle structure. This prevents the closure from being manually removed from the bottle and, inadvertently, being misplaced.

It is also to be understood that the following claims are intended to cover all of the generic and specific features of the invention herein described and all statements of the scope of the invention which might be said to fall therebetween.

What is claimed is:

1. A secure closure of the type useful on pill containers, said closure comprising a top closure member and a lower closure member which are mounted for vertical and rotational movement relative to one another;

apertures in each of said top and lower members which are positioned to be brought into register by rotation, and to form a pill dispensing port;

lock means to prevent relative rotation of said closure members when said members are in a first vertical relationship, one to the other, said top closure forming means to disengage said lock means on lifting of said top closure member away from said lower closure member;

stop means to prevent relative rotation of said closure members past the point at which said pill dispensing port is formed;

biasing means to hold said closure member in said first position that said apertures are maintained in non-registered position and wherein said biasing means comprises a coil spring forming means to resist the lifting, and to return said top closure member to its locked position and also comprises a spring means to return said top closure member to the locked rotational position.

2. A secure closure as defined in claim 1 wherein said top closure member has a circumferential edge forming means by which to manipulate and turn said closure, said surface being at least 3 cm in diameter.

3. A secure closure as defined in claim 1 wherein said biasing means is formed of a single continuous element.

4. A secure closure as defined in claim 1 wherein said closure comprises (1) a plurality of lock means to prevent rotational movement, said lock means positioned about 180° apart, and (2) wherein said top closure forms lift means to disengage said lock means.

5. A secure closure as defined in claim 1 wherein said closure comprises (1) a plurality of lock means to prevent rotational movement, said lock means positioned about 180° apart, and (2) wherein said top closure forms lift means to disengage said lock means.

6. A container of the type adapted to provide security against access to the ingredients by children, said container comprising a secure closure of the type useful on pill containers, said closure comprising a top closure member and a lower closure member which are mounted for vertical and rotational movement relative to one another;

apertures in each of said top and lower members which are positioned to be brought into register by rotation, and to form a pill dispensing port;

lock means to prevent relative rotation of said closure members when said members are in a first vertical relationship, one to the other, said top closure forming means to disengage said lock means on lifting of said top closure member away from said lower closure member;

stop means to prevent relative rotation of said closure members past the point at which said pill dispensing port is formed;

biasing means to hold said closure member in said first vertical position and in such rotational position that said apertures are maintained in non-registered position; and wherein said biasing means comprises a coil spring forming means to resist the lifting, and to return said top closure member to its locked position and also comprises a spring means to return said top closure member to the locked rotational position.

7. A container as defined in claim 6 wherein the closure is attached to said bottle by means sufficient to prevent manual removal therefrom.

* * * * *